United States Patent [19]

Bluthardt et al.

[11] Patent Number: 5,007,644

[45] Date of Patent: Apr. 16, 1991

[54] GOLF PUTTING PRACTICE TARGET

[76] Inventors: Edward A. Bluthardt, 6612 Lakepointe, Utica, Mich. 48089; Jeffrey L. Goins, 55605 Card Rd., New Haven, Mich. 48048

[21] Appl. No.: 512,794

[22] Filed: Apr. 23, 1990

[51] Int. Cl.[5] ..... A63B 57/00; A63B 67/02

[52] U.S. Cl. ..... 273/178 B; 273/176 H; 273/DIG. 31

[58] Field of Search ..... 273/177 R, 178 R, 178 B, 273/176 H, DIG. 31, 181 R; 434/252

[56] References Cited

U.S. PATENT DOCUMENTS

| | | | |
|---|---|---|---|
| 1,612,292 | 12/1926 | Jackson | 273/178 B |
| 1,983,044 | 12/1934 | Maynard | 273/DIG. 31 X |
| 3,534,961 | 10/1970 | Tiley | 273/176 H X |
| 3,727,917 | 4/1973 | MacLean | 273/176 H |
| 4,198,050 | 4/1980 | Goldfarb et al. | 273/DIG. 31 X |
| 4,222,568 | 9/1980 | Russo | 273/176 H |
| 4,743,027 | 5/1988 | Simjlan | 273/178 R |
| 4,930,784 | 6/1990 | Jordan | 273/178 B |

*Primary Examiner*—William H. Grieb

*Attorney, Agent, or Firm*—John R. Benefiel

[57] ABSTRACT

A golf putting practice target is disclosed comprised of a one piece molded plastic target piece adapted to rest on a floor surface. The target requires careful control over the speed of the ball, which must be putted so as to be directed into an intermediate depression formed between the peaks of a gently inclined entrance ramp and a more steeply inclined back ramp, without returning out of the depression because of a too fast putt. The height of the peak of the back ramp is substantially higher than the height of the peak of the entrance ramp so that any slight excess speed of a stroked golf ball will likely result in escape from the intermediate depression by returning past the entrance ramp peak. In a preferred embodiment a strip of carpet covers the entrance ramp, extending from the peak to a point, forward of the target piece to provide a putting approach surface. A target visual feature is applied centered at the peak, with the edge of the carpet cut to surround half of the target and create a slightly confining effect so that perfectly stroked balls will come to rest on the target.

12 Claims, 2 Drawing Sheets

GOLF PUTTING PRACTICE TARGET

This invention concerns practice devices for the game of golf, and more particularly a putting practice target.

In putting, it is sometimes critical to precisely control the speed of the putted ball, such as in making the infamous downhill putts. While in the past there have been devised a great number of putting practice targets, these targets have not in the main required precise control over the speed of the putted ball as a critical factor in achieving successful shots to the target. These prior targets have primarily concerned accuracy in the direction of the putt.

Another factor in the success of a practice device is the entertainment derived from practice sessions. A drawback of most prior putting targets is the lack of amusement derived from the practicing effort. Obviously, the more entertaining the practice is, the more the user will practice, and this will result in more improvement to a user's skill.

Of course, compactness and simplicity of a target will keep its cost lower and enhance the convenience of use and storage.

SUMMARY OF THE INVENTION

The present invention comprises a golf putting target requiring precise control over the speed of the stroked ball to successfully score the target with a practice putt. This target comprises a simple, compact target piece adapted to rest on a putting surface such as a carpeted floor, having an entry ramp comprised of a gentle upward sloping surface bounded on each side by confining side walls. The entry ramp surface rises a very low height to a peak, thereafter descending to a gently curved intermediate depression, the back side of which is formed by an uninterrupted, back ramp portion, upwardly rising to a peak height above that of the entry ramp peak.

Thus, if a putted ball ascends the back ramp to a height above the entrance ramp peak, the putted ball will have sufficient potential energy so that when returning, it will climb completely over the entrance peak, thereby escaping the intermediate depression. To prevent this escape, the putter must therefore carefully control the speed of the putt, avoiding too hard or too easy stroking of the ball, to allow the ball to neither climb over the back ramp or return past the entrance ramp peak, and remain in the intermediate depression, representing a successful putt.

The difficulty in accomplishing this end lends considerable entertainment value to the use of this practice target.

In a preferred embodiment, a carpet strip covers the entrance ramp and extends to provide a putting approach surface. The leading edge of the carpet strip lies at the peak of the entrance ramp, which bears a target circle, the carpet edge cut out to surround half of the target. The slight confining effect of the edge of the carpet strip enables a perfectly putted golf ball to remain in the target.

DETAILED DESCRIPTION

Figure 1:
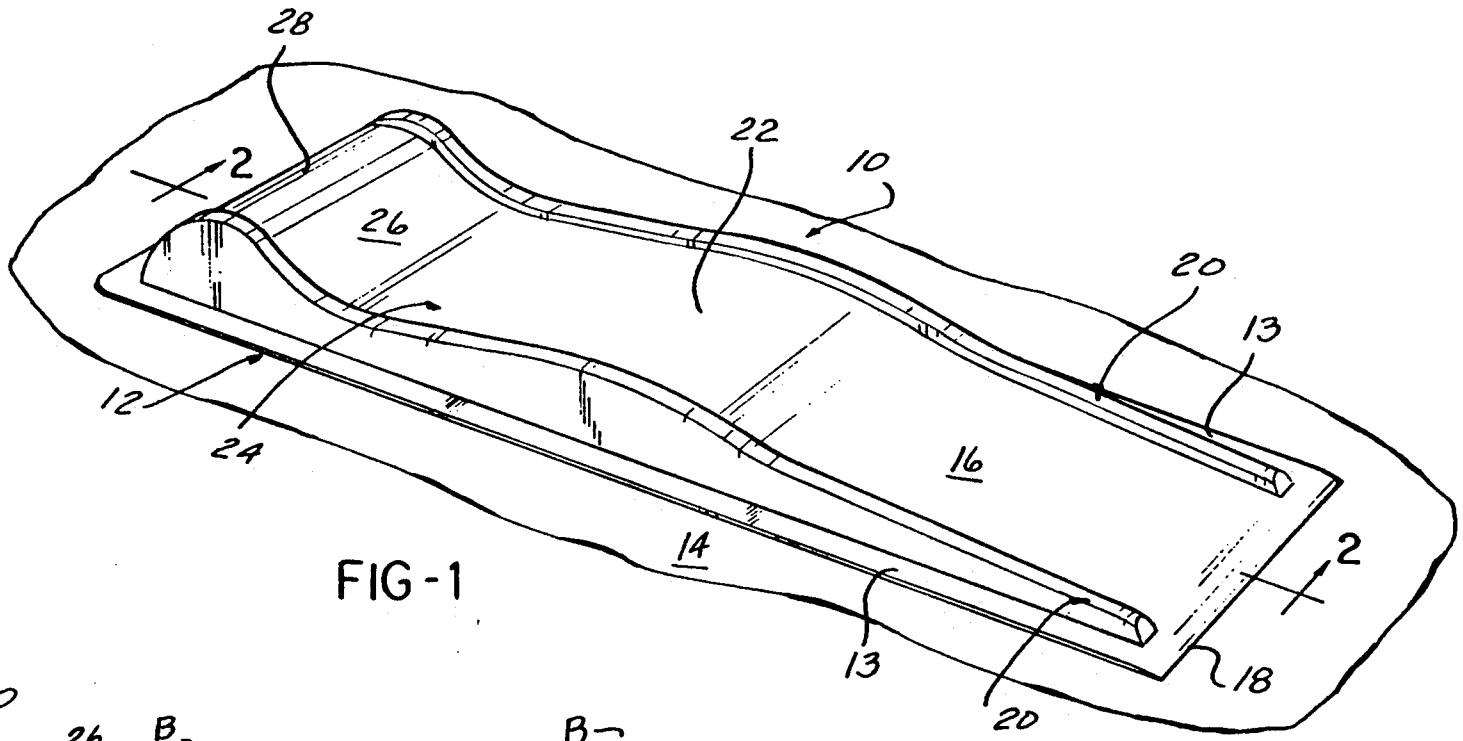
FIG. 1 is a perspective view of the golf putting practice target according to the present invention.
Figure 2:
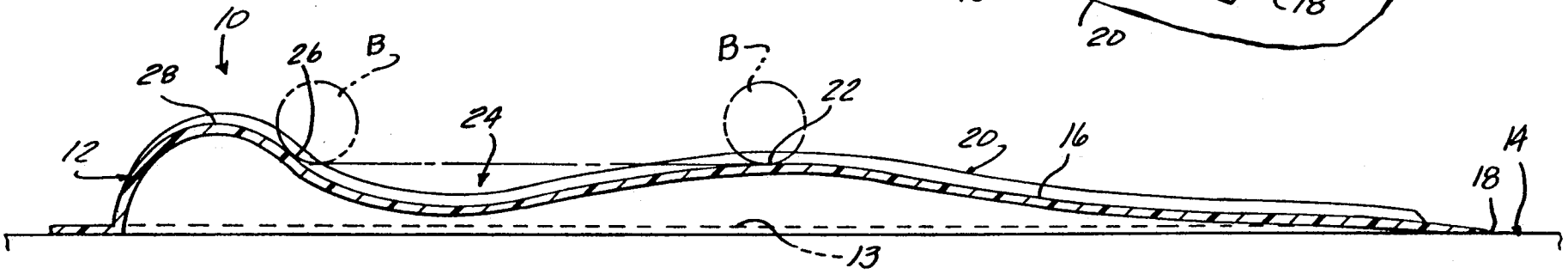
FIG. 2 is a longitudinal sectional view of the practice target shown in FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to FIGURE the putting practice target 10 according to the present invention comprises a lightweight shaped piece 12, as of molded plastic, having flanges 13 adapted to rest on a supporting surface 14, such as a carpeted floor.

The piece 12 includes an entry ramp surface 16 gently inclined upwardly from a leading edge 18 facing the putter.

The entry ramp surface 16 is a few inches in width, i.e., five to ten inches to be on the same order of magnitude of the standard golf cup, bounded by confining side walls 20 to define a target area suitable for putting practice from normal putting distances.

The entrance ramp surface 16 is smooth and uninterrupted, continuing at a very gentle inclination upwardly to a peak 22, at a low height, on the order of the diameter of a golf ball B as shown.

Thereafter, the ramp surface continues downwardly, forming one side of a curved intermediate depression 24. The opposite side of the intermediate depression 24 is formed by a back ramp surface 26, upwardly rising from the low point of the intermediate depression 24 to a peak 28 at a height well above the peak 22 of the entrance ramp 16, on the order of one and one half times the diameter of a golf ball B, as shown.

The surface of the intermediate depression 24 and the back ramp 26 is smooth and uninterrupted. The substantially higher height of the peak 28 of the back ramp surface 26 compared to the peak 22 of the entrance ramp 16 creates the designed-for effect.

It can be seen that a putted ball B can ascend the back ramp surface 26 to the same or greater height than the peak 22 of the entrance ramp. Consider further that the ball B in descending the peak 22 into the intermediate depression 24 will gain kinetic energy sufficient to ascend almost to that level, even if starting from rest. If the ball B climbs at least to that height but does not go over, it will descend the back ramp surface 26 and gain sufficient kinetic energy to escape the intermediate depression 24 and return down the entrance ramp 16 to the putter.

Thus, if the ball B is putted with sufficient speed to ascend the entrance ramp 16 and move past the peak 22 at any substantial speed, escape from the intermediate depression 24 in either the forward or return direction is inevitable. This need for precise control over the speed of the putted ball makes for a challenge to the practicer, who is required to precisely gauge the speed .of the putt so that the ball B remains in the intermediate depression 24, neither passing completely over the peak 28 of back ramp 26 nor returning over the peak 22 of the entrance ramp 16.

The ball B will also be returned directly to the putter if escaping the intermediate depression 24 increasing the convenience to the user.

The entrance ramp 16 is very gently inclined to provide a smooth transition from the floor surface. Since a smooth contour is built into the back ramp 26, the back ramp surface 26 can be much more steeply inclined to shorten the overall length of the target 10.

The height of the peak 28 by the back ramp 26 is selected to be sufficiently high to insure that most improperly stroked putts will not escape over the peak 28, but rather be returned to the putter over peak 22.

Figure 3:
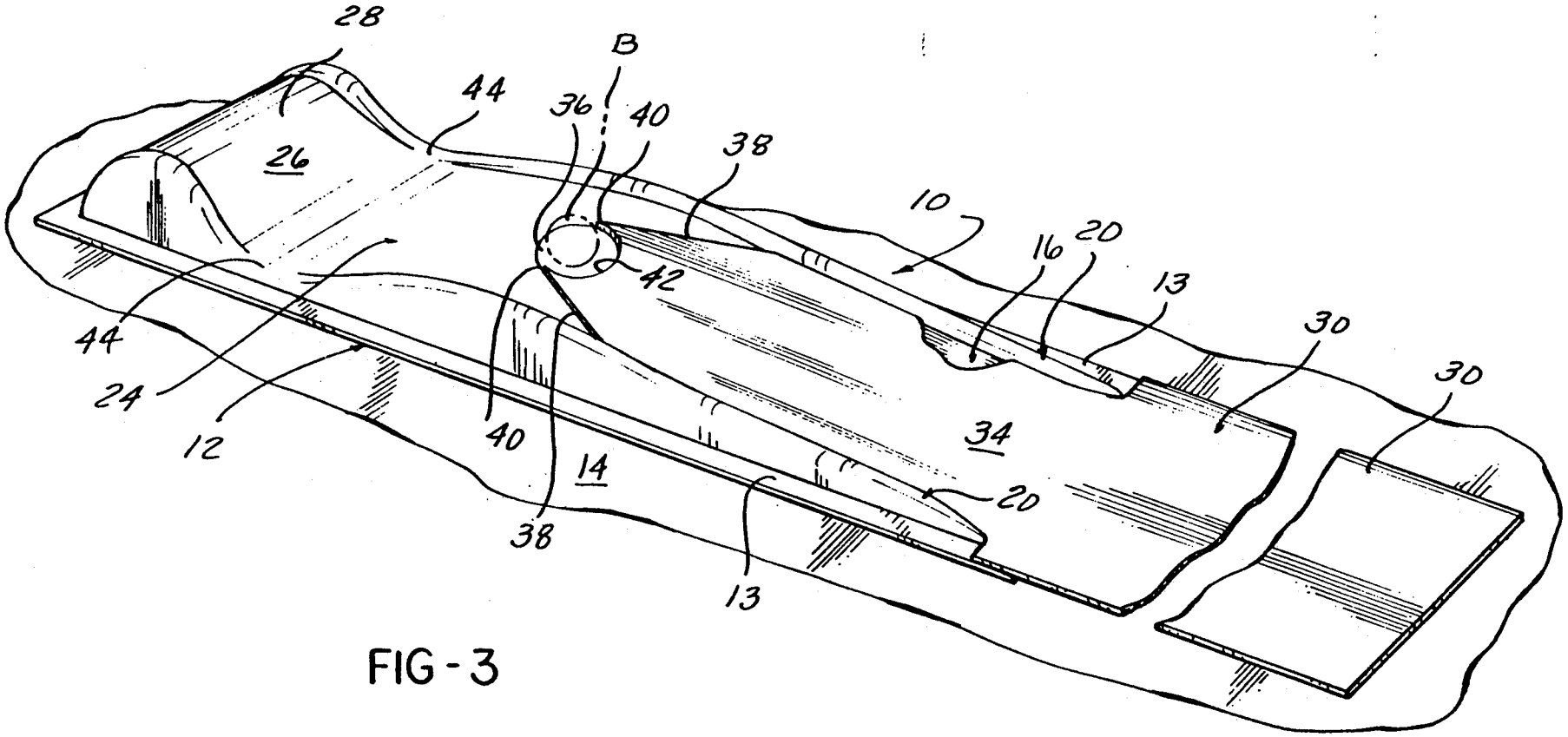
FIG. 3 is a perspective view of an alternate, preferred embodiment of the practice target according to the present invention.

Referring to FIG. 3, a preferred embodiment of the target 10 is shown. In this embodiment, a strip or elongated section of carpet 30 is attached to the ramp surface 16 as with an adhesive, and extends forwardly of the piece 12. The portion 32 to the front defines a putting surface for the approach to the target 10. The portion 32 is of the same width as that of the overall width of the target, but narrows at the sidewalls 20 to the width between the sidewalls 20, the leading corners angled at the transition. The carpet section 34 on the entrance ramp 16 extends to the peak 22 and terminates there with a particularly confined edge. A visible circular target 36 is provided, applied as a decal or otherwise placed at the top of the peak 22, and centered between the sidewalls 20.

The leading edge of the carpet section 36 is located at the midpoint of the peak 22 on the forward side, cut out in a semicircle so as to partially surround the target 36 as shown, acting as a slightly confining feature. The carpet section 34 is cut back on a diagonal 38 so as to minimize the extent of edge at the top of the peak 22, leaving only points 40. The perfectly stroked putt will leave a ball B at the top of the peak 22 on the target 36, slightly confined by the carpet edge 42 at the rear of the target 36. Shots can be directed to the target 36 either by a perfectly placed shot up the entrance ramp 16, or by a perfectly centered return from the depression 24. A return to either side will move over the carpet edge along the diagonals 38 due to the downward roll from the slant of the ramp 16 from the peak 22.

A shot to the depression 24 will also count as a successful but not perfect shot.

In order to prevent accumulation of balls in the depression 24, the side walls 20 can be eliminated at the bottom of the depression 24, with a very slight inclination to the outside allowing balls to roll out through either of the openings 44 in the sidewalls 20 so formed.

The target 10 while designed as a putting practice aid, could of course be employed as a game, in which points are awarded for perfect and non-returned shots into the depression 24.

What is claimed is:

1. A golf putting practice target comprised of a target piece adapted to rest on a supporting surface; said target piece formed with an entrance ramp comprised of an upwardly ascending smooth and uninterrupted surface bounded by confining spaced apart a distance on the order of several inches;

said entrance ramp rising at a very gentle inclination to a peak;

said entrance ramp thereafter descending into a curved intermediate depression, bounded at the rear by a back ramp surface rising to a peak at a height above said entrance ramp, said intermediate depression and back ramp being smooth and uninterrupted.

2. The golf practice target according to claim 1 wherein the distance between said confining sidewalls is from five to ten inches.

3. The golf practice target according to claim 1 wherein said back ramp is much more steeply inclined than the entrance ramp.

4. The golf practice target according to claim 1 wherein the height of the peak of the entrance ramp is on the order of the diameter of a golf ball.

5. The golf practice target according to claim 4 wherein the height of the peak of the back ramp is on the order of one and one half times the diameter of a golf ball.

6. The golf practice target according to claim 4 wherein said target piece is of a one-piece molded plastic construction.

7. The golf practice target according to claim 1 wherein a strip of carpet is attached covering said entrance ramp, with a leading edge at the peak of the entrance ramp.

8. The golf practice target according to claim 7 wherein said carpet strip extends forwardly of the target piece to provide a putting approach surface.

9. The golf practice target according to claim 7 wherein a centered visual target is applied to the surface of the entrance ramp peak.

10. The golf practice target according to claim 9 wherein the leading edge of the carpet strip is cut out to surround the target on the front side thereof.

11. The golf practice target according to claim 10 wherein the leading edge of the carpet strip is cut on the diagonal from the cut out at said target to the sidewalls, leaving points at the forwardmost extent on either side of said target.

12. The golf practice target according to claim 1 wherein said sidewalls have openings on either side of said intermediate depression and a slight inclination directing balls to the side allowing balls putted into said intermediate depression to escape.

* * * * *